United States Patent [19]

Nishida

[11] Patent Number: 4,635,582

[45] Date of Patent: Jan. 13, 1987

[54] APPARATUS FOR PREVENTING A CAPSIZED BOAT FROM SINKING

[75] Inventor: Hiroshi Nishida, Miki, Japan

[73] Assignee: Kawasaki Jukogyo Kabushiki Kaisha, Kobe, Japan

[21] Appl. No.: 752,152

[22] Filed: Jul. 3, 1985

[30] Foreign Application Priority Data

Jul. 5, 1984 [JP] Japan ..... 59-139395

[51] Int. Cl.[4] ..... B63B 43/02; B63H 21/32

[52] U.S. Cl. ..... 114/360; 114/270; 440/88

[58] Field of Search ..... 114/355, 360, 270; 440/89, 88, 68, 38

[56] References Cited

U.S. PATENT DOCUMENTS 3,623,447 11/1971 Jacobson ..... 114/270
4,194,460 3/1980 Sato et al. ..... 440/88
4,509,926 4/1985 Jacobson ..... 440/89
4,568,293 2/1986 Yazaki ..... 440/88

*Primary Examiner*—Sherman D. Basinger
*Assistant Examiner*—Paul E. Salmon
*Attorney, Agent, or Firm*—Marshall, O'Toole, Gerstein, Murray & Bicknell

[57] ABSTRACT

This disclosure relates to a boat including a hull which forms a closed engine compartment. The compartment is air-tight at and above the water line or draft level which is formed when the boat is overturned in the water. The boat further includes an air inlet duct and an exhaust duct which extend into the engine compartment. Each of the ducts has one end which opens in the compartment above the draft level, and another end which is out of the compartment and below the draft level, thereby forming an air space in the compartment when the boat is overturned.

3 Claims, 2 Drawing Figures

APPARATUS FOR PREVENTING A CAPSIZED BOAT FROM SINKING

FIELD AND BACKGROUND OF THE INVENTION

The present invention relates to apparatus for preventing a relatively small boat or other water craft from sinking when capsized or overturned.

Relatively small recreational boats have become very popular in recent years, and are known as a water jet type boat or small motor boat. Such a boat includes a hull which forms an engine compartment. The engine for propelling the boat is, of course, mounted within the compartment, and ducts for the engine intake air and the engine exhaust extend through the hull. When a conventional small boat of this type is overturned in the water, the water floods into the engine compartment through the air inlet duct and the exhaust duct, etc., and it is difficult for the boat to maintain sufficient buoyancy to remain afloat.

It is a general object of the invention to provide a small boat including means for maintaining sufficient buoyancy by forming an air space in the engine compartment when the boat is overturned.

BRIEF SUMMARY OF THE INVENTION

A boat according to the invention includes a hull which forms a closed engine compartment. The compartment is air-tight at and above the water line or draft level which is formed when the boat is overturned in the water. The boat further includes an air inlet duct and an exhaust duct which extend into the compartment. Each of the ducts has one end which opens in the compartment, and another end which is out of the compartment and below the draft level, thereby forming an air space in the compartment when the boat is overturned.

BRIEF DESCRIPTION OF THE DRAWINGS

A preferred embodiment of the invention is described below in conjunction with the figures of the accompanying drawings, wherein.

DETAILED DESCRIPTION OF THE DRAWINGS

Figure 1:
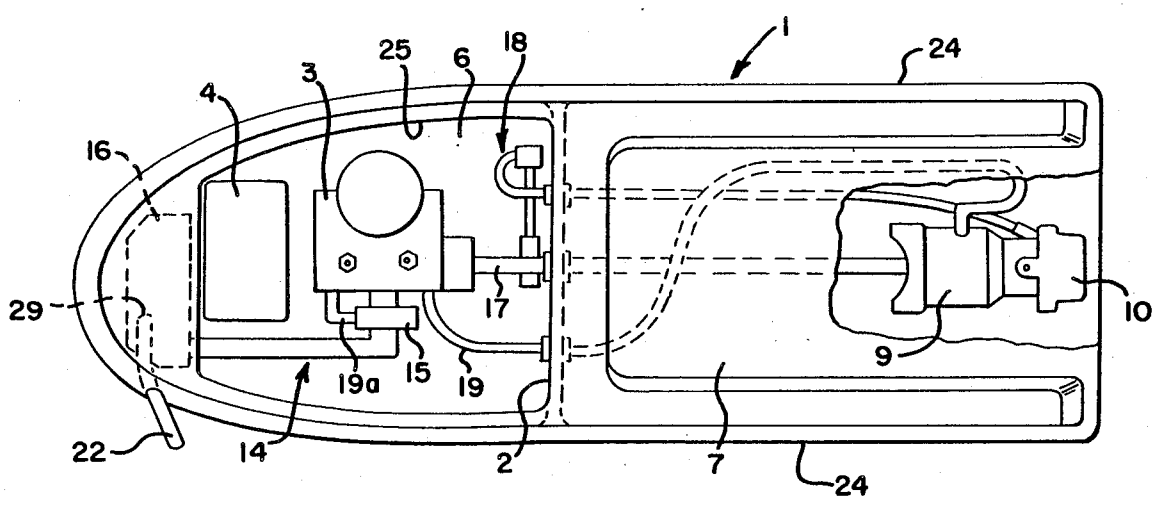
FIG. 1 is a top plan view of a small boat according to the invention, with parts removed to show underlying parts.

With reference to the drawings, the boat includes a hull 1 that forms a water-tight enclosure across the bottom 23 and sides 24 of the boat. The hull 1 is formed with a bulkhead 2 which extends transversely of the hull at approximately the center of the boat and partitions the hull into an engine compartment or room 6 at the fore part, and an aft section. The room 6 contains an internal combustion engine 3 and a fuel tank 4 forward of the engine, which are secured to the bottom of the hull. The hull has a top opening 25 above the room, which is normally closed with an engine hood 5.

The aft section of the hull 1 has an operator's deck 7 formed on the upper side thereof. Formed under the stern is a water channel 8 in which an axial-flow pump 9 is mounted on the hull to produce a water jet for propulsion of the boat. Also mounted on the outlet side of the pump 9 is a pivotable guide duct 10 for changing the direction of water jet in order to steer the boat.

Figure 2:
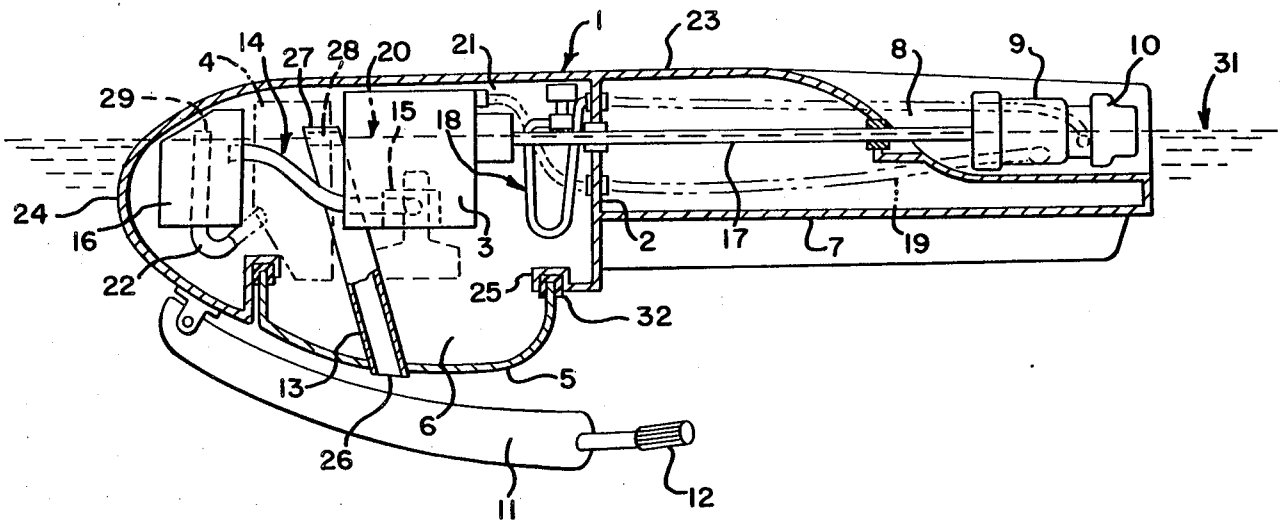
FIG. 2 is a sectional side view showing the boat of FIG. 1 in a capsized condition.

As shown in FIG. 2, a control boom 11 is pivotably mounted on the hull 1 and extends rearwardly over the hood 5. The boom 11 terminates in handles 12 for operating the engine and steering with the guide duct 10. During operation of the boat, an operator stands, kneels, etc. on the deck 7, pivots the boom 11 upwardly to a comfortable height, and controls the boat using the handles 12.

An air inlet duct 13 extends through a hole in the hood 5 and is secured to the hood, for feeding atmospheric air for the engine into the room 6. The duct 13 terminates at its normally upper end 26 at an opening in the hood 5, and at the other normally lower end 27 in the room 6.

The air duct 13 may have a check valve 28 provided adjacent the lower end 27 in the engine room 6. The valve 28 is open when the boat is in the normal upright position, and it automatically closes to minimize the amount of flooding into the room 6 when the boat is overturned. The valve 28 may preferably be a conventional gravity actuated type, which has a valve body formed or actuated by a weight.

The room 6 also encloses an exhaust system for the engine 3. An exhaust duct 14 (FIG. 1) receives discharged exhaust gas from the engine. The duct 14 extends from the cylinder exhaust port of the engine 3 to a cooling water injector 15 adjacent the port, and then from the injector 15 to a muffler 16 adjacent the bow. From the muffler 16 extends another exhaust duct 22 which passes through an opening in a side wall 24 of the hull 1 adjacent the bow, and opens into the atmosphere.

The crankshaft of the engine 3 is coupled to a drive shaft 17 which extends rearwardly through the bulkhead 2 and the aft section of the hull to the stern, and is connected to drive the jet pump 9.

A bilge duct 18 extends from an intake end mounted in the engine room 6, through the bulkhead 2 and the aft hull section, to the outlet of the pump 9. It operates to suck any water collecting in the bottom of the room 6 through a filter and to discharge it from the hull by the jet pump principle.

An engine-cooling duct 19, which receives water from the outside of the hull 1 has an exterior end at the outlet of the pump 9 and diverts part of the water discharged from the pump. The duct 19 extends through the aft hull section and the bulkhead 2 to the cooling water jacket of the engine 3 and circulates the diverted water through the engine.

The cooling line 19 includes a duct **19*a* (FIG. 1) which extends from the cooling water jacket to the cooling water injector 15 of the exhaust duct 14**, in order to mix the water from the cooling water jacket with the exhaust gas and to discharge the water along with the gas from the hull. As a result, not only the engine cylinder but also the exhaust system can be cooled, and it also serves to quiet the engine.

FIG. 2 shows the boat overturned in the water, and the dash-dot line 31 represents the surface of the water. The boat in its overturned condition has a draft level or water line 20, and at least the engine room portion of the hull above (as seen in FIG. 2) the level 20 is constructed air tight. The exterior ends of the air inlet duct 13 and the exhaust duct 22, which open outside of the hull 1, are located underwater below the level 20 as shown in FIG. 2. Consequently an air reservoir or space 21 is formed in an upper portion (as seen in FIG. 2) of the engine room 6, which is adjacent the bottom wall 23 of the hull. This is similar to the manner in which air is trapped within a bowl or canoe which is quickly overturned in the water. The trapped air in the space 21 thus forms a buoyant force which prevents the boat from sinking when the boat is overturned.

When in this condition, the trapped air in the engine room 6 should not be consumed by the engine. Consequently, it is preferred that the engine 3 be designed to automatically shut off when the boat is overturned, and this may be accomplished by a gravity actuated control switch.

In FIG. 2, the interior end 27 of the air duct 13, which opens in the engine room 6, is located above the draft level 20. Also, the interior end 29 of the exhaust duct 22, which opens in the muffler 16 in the engine room, is located above the level 20. As a result, the air space 21 is prevented from being flooded through the ducts 13 and 22 which extend between the engine room 6 and the outside of the hull 1. This minimizes the amount of water flooding into the hull, so as to maintain sufficient buoyancy.

In FIG. 2, the bilge duct 18 and the cooling duct 19 extend out of the hull 1 to the pump 9 and their exterior ends are also below the water level 31 when capsized, so as to keep the air from escaping. The outlet end of cooling line 19 is connected to the exhaust duct 14 through the injector 15, so as to open out of the engine room 6 or the hull 1 in common with the exhaust duct 14. It is preferable to position intermediate portions of these ducts 18 and 19 above the level 20, so as to prevent the flow of water into the engine room.

It is necessary to make air-tight seals at the holes which are not below the level 20 in the bulkhead 2 in FIG. 2, these holes being those through which the propeller shaft 17 and the bilge duct 18 extend, so as to prevent air leakage out of the space 21 when capsized. It is also preferable to seal the hole below (in FIG. 2) the level 20 in the bulkhead 2, through which the cooling line 19 extends, so as to prevent water flood. The cover 5 should also be sealed as indicated at 32 where it connects with the hull.

What is claimed is:

1. A water craft comprising a hull, a portion of said hull forming an enclosed engine room, an engine having an exhaust system mounted in said engine room, said hull having a water line when overturned in the water and with relatively little water in said room, and said portion of said hull being constructed air-tightly at and above said water line when said craft is overturned, an air inlet duct and an exhaust duct each extending through said hull and into said room, said exhaust system carrying engine exhaust during operation of the engine, said exhaust duct forming part of said exhaust system and having an interior opening located above said water line when said hull is overturned, said air inlet duct having an interior end opening in said room and each of said ducts having an exterior end opening out of said room and below said water line when said hull is overturned, so as to form a trapped air space in said room when said craft is overturned.

2. A craft according to claim 1, and further including at least one water-carrying duct extending from said engine room and through said hull, said water-carrying duct having an exterior end located below said water line when said craft is overturned and a portion within said engine room which is above said water line.

3. A water craft comprising a hull having fore and aft ends, a portion of said hull adjacent said fore end forming an enclosed engine room, an internal combustion engine within said engine room, an engine exhaust duct connected to said engine and carrying engine exhaust from said engine during operation of said engine, said hull having a water line when overturned in the water and with relatively little water in said engine room, said portion of said hull being air-tight at and above said water line when said hull is overturned, an engine air inlet duct each of said inlet and exhaust ducts extending through said hull and having an interior end which is within said room and above said line, and an exterior end which is outside of said hull and below said line.

* * * * *